US006422421B1

(12) United States Patent
Freudinger et al.

(10) Patent No.: US 6,422,421 B1
(45) Date of Patent: Jul. 23, 2002

(54) DISPENSING APPARATUS

(75) Inventors: Mark J. Freudinger, Peotone; David J. White, Frankfort, both of IL (US)

(73) Assignee: Quantum Technical Services, Inc., Peotone, IL (US)

( * ) Notice: Subject to any disclaimer, the term of this patent is extended or adjusted under 35 U.S.C. 154(b) by 0 days.

(21) Appl. No.: 09/628,083

(22) Filed: Jul. 28, 2000

(51) Int. Cl.[7] ..... B67D 5/16

(52) U.S. Cl. ..... 222/63; 222/71; 222/74; 222/529; 222/530

(58) Field of Search ..... 222/63, 71, 74, 222/75, 333, 527, 529, 530, 537

(56) References Cited

U.S. PATENT DOCUMENTS 3,797,703 A * 3/1974 Yamawaki et al. ..... 222/74
5,020,725 A * 6/1991 Waldrum ..... 222/333
5,472,124 A * 12/1995 Martushev ..... 222/529
6,041,973 A * 3/2000 Bailey ..... 222/529
6,227,409 B1 * 5/2001 Brown ..... 222/71

* cited by examiner

*Primary Examiner*—Joseph A. Kaufman
(74) *Attorney, Agent, or Firm*—Jones, Day, Reavis & Pogue

(57) ABSTRACT

A pizza sauce dispensing apparatus that includes a base, a motor mounted within the base, a pump mounted to the base, a container of sauce mounted on the base, a removable conduit connecting the container and the pump, a valve removably mounted to the container, a nozzle, another removable conduit between the pump and the nozzle, a nozzle switch, a bracket for storing the nozzle when not in use, an electrical control circuit for programming the apparatus to dispense sauce as a function of pizza size, a sauce addition switch and a sauce subtraction switch, and an electrical path including two metal posts and wire from the base to the nozzle switch. The parts having the sauce path are removable and washable even though some of the parts include an electrical path which typically cannot be immersed in water. The result is an efficient, relatively inexpensive apparatus.

38 Claims, 8 Drawing Sheets

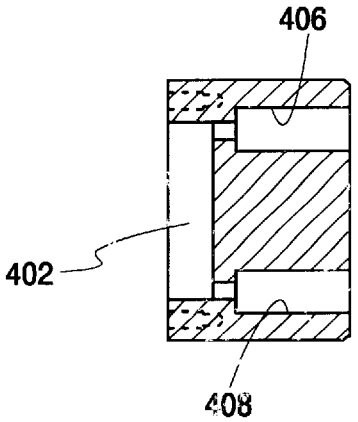
Fig. 24
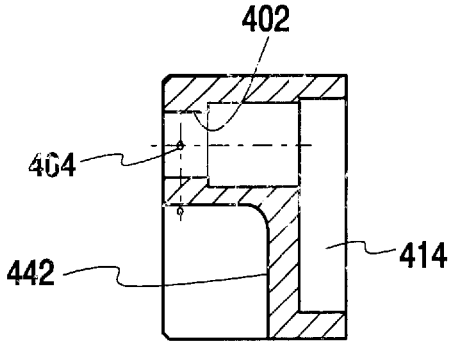
Fig. 25
Fig. 26
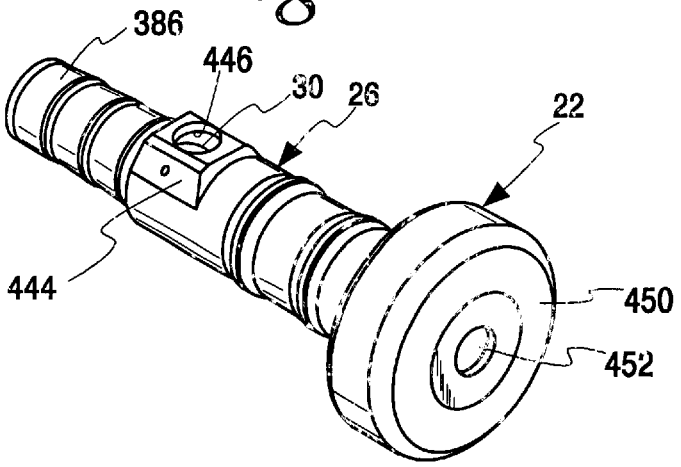
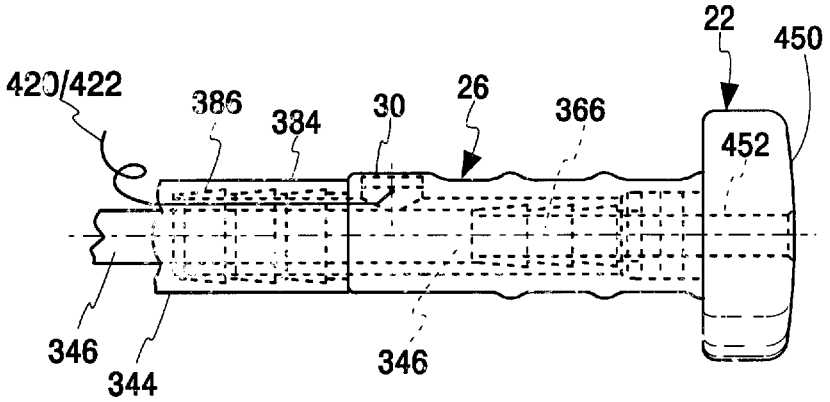
Fig. 27

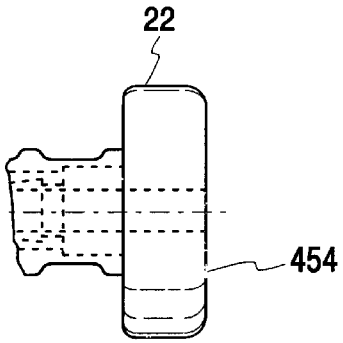
Fig. 28
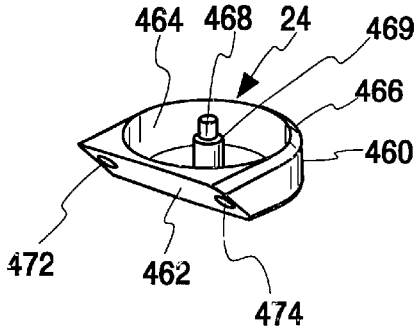
Fig. 29
Fig. 30
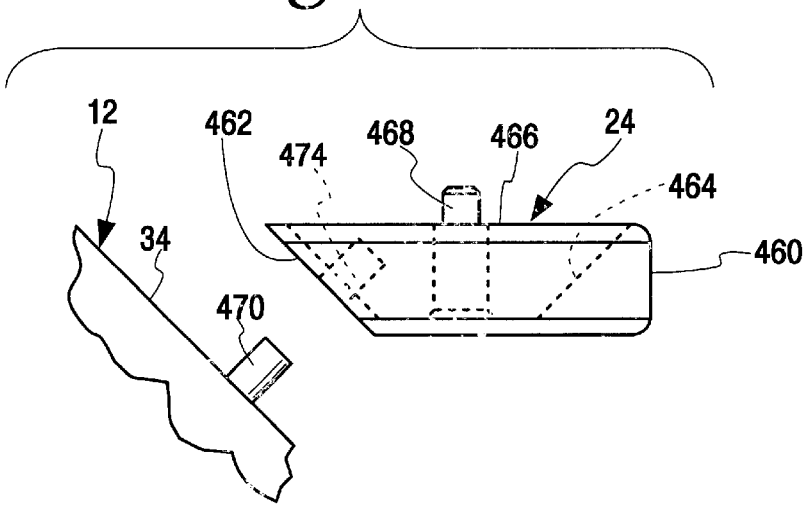
Fig. 31
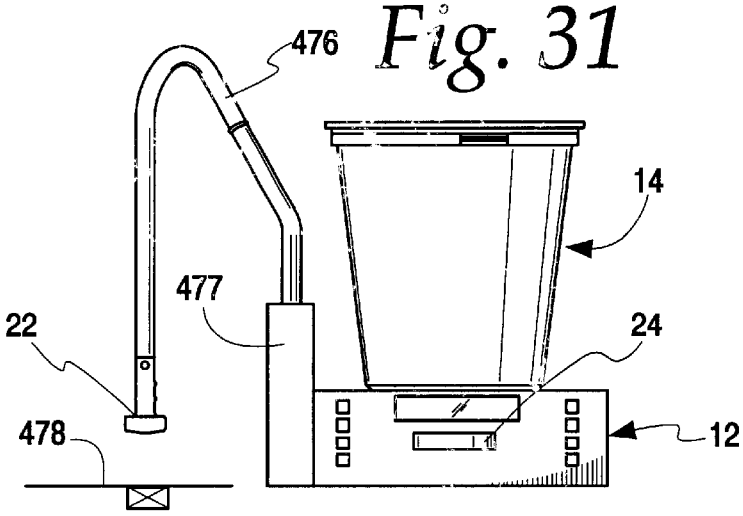

DISPENSING APPARATUS

BACKGROUND OF THE INVENTION

1. Field of the Invention

The present invention relates to a dispensing apparatus and more particularly to a food dispensing apparatus which is efficient, reliable and effective.

2. Description of the Related Art

Food dispensing devices are well known in the art. For example, single and multiple condiment dispensing devices, usually with under-counter condiment bags and a carbon dioxide tank to power the devices, are currently on the market. With such devices dispensing nozzles are located above the counter for use by consumers or by professional food preparers.

There are also dispensers for such food products as pizza sauce. These include a nozzle having the shape of a ladle. The handle for the ladle includes a sauce conduit which empties into the ladle, and there is an operating switch, also attached to the handle, to activate the compressed gas which forces the sauce from a sauce container to the ladle when the switch is activated. Other nozzles for pizza sauce dispensing include those having a spoodle base. These may be suspended from flexible overhead hoses so as to leave counter space free for food items. Counter top devices including the spoodle nozzle base, a flexible hose, a base unit with a pump and a motor and a sauce container mounted on the base have all appeared in the marketplace, but each such device has undesirable shortcomings.

The above described devices have, however, a number of desirable features when compared to dispensing food items manually. For example, they provide reproducible, consistent portions, and they provide for faster food preparation. They also tend to be more sanitary, there is less spoilage and waste, and less counter space is used for equipment. Nevertheless, there is a need for more reliable and efficient structures than those which now exist.

BRIEF SUMMARY OF THE INVENTION

The difficulties encountered by previous systems have been overcome by the present invention.

What is described here is a dispensing apparatus comprising a base, a motor operatively connected to the base, a pump operatively connected to the base, a conduit adapted to connect to the pump and a container of product to be pumped, a nozzle operatively connected to the pump and being movable between a storage position and a dispensing position, a second conduit for connecting the pump and the nozzle, an electrical conducting wire adapted to connect the motor to a source of power, a first switch connected to the electrical line adapted to control power from a source and a bracket removably mounted to the base for mounting the nozzle when the nozzle is in the storage position and for controlling leakage of product from the nozzle. The invention is disclosed in another manner by providing a dispensing apparatus comprising the base, the motor, the pump, the first conduit, the nozzle, the second conduit, the electrical conducting wire, the first switch and a monitoring element operatively connected to the motor for indicating the number of revolutions made by the pump. The invention also includes a dispensing apparatus comprising the base, the motor, the pump, the first conduit, the nozzle, the second conduit, the electrical conducting wire, the first switch, a container for storing the product to be pumped, a valve having a valve seat, an element movable between open and closed positions, and a biasing element, the valve being removably connected to the container and the movable element being biased to the closed position, and an end portion on the first conduit for biasing the valve element to its open position. Further the invention may be described as a dispensing apparatus comprising the base, the motor, the pump the first conduit, the nozzle, the second conduit, the electrical conducting wire, the first switch where the switch is connected to the nozzle and is movable therewith an electrical path connecting the second conduit and operatively connected to the switch and the motor, the electrical path including two metal rods and electrical wire.

An object of the present invention is to provide a dispensing apparatus which is reliable and relatively inexpensive. A further aspect of the present invention is to provide a dispensing apparatus which is efficient and which utilizes a minimum number of parts for ease of handling. Another aim of the present invention is to provide a dispensing apparatus which is easy to disassemble and clean and thereafter reassemble. Still a further advantage of the present invention is to provide a dispensing apparatus with an electrical path that is effective in operation and yet the apparatus may be immersible in water without damage. Still another object of the present invention is to provide a dispensing apparatus which includes an inexpensive and effective shut-off valve structure, a simple but accurate mechanism for metering the dispensing product and a bracket for cleanly cradling the dispensing nozzle when it is not in use.

A more complete understanding of the present invention and other objects, aspects, aims and advantages thereof will be gained from a consideration of the following description of the preferred embodiments read in conjunction with the accompanying drawings provided herein.

BRIEF DESCRIPTION OF THE SEVERAL VIEWS OF THE DRAWINGS

FIG. 24 is a sectional elevation view taken along line 24—24 of FIG. 22.

FIG. 25 is a sectional elevation view taken along line 25—25 of FIG. 23.

FIG. 26 is an isometric view of the nozzle and the nozzle handle shown in FIG. 16.

FIG. 27 is an elevation view of the nozzle shown in FIG. 26.

FIG. 28 is a partial elevation view of a variation of the nozzle shown in FIGS. 26 and 27.

FIG. 29 is a rear isometric view of a bracket of the food dispensing apparatus shown in FIGS. 1 and 2.

FIG. 30 is an enlarged elevation view of the bracket shown in FIG. 29.

FIG. 31 is a diagrammatic elevation view of an automated food dispensing apparatus.

DETAILED DESCRIPTION OF THE INVENTION

Figure 1:
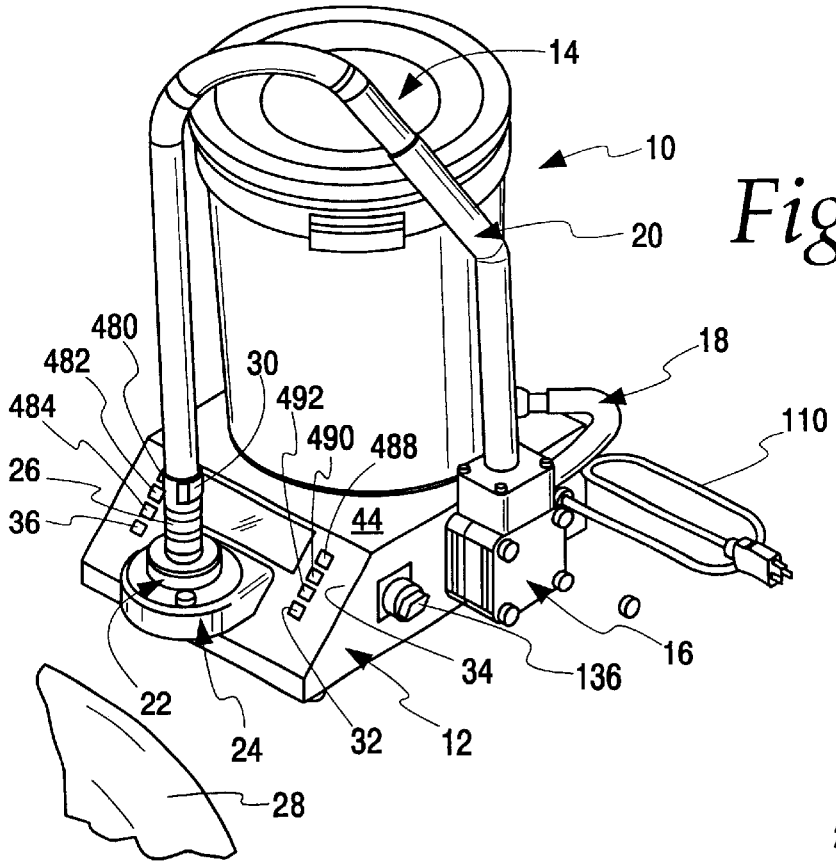
FIG. 1 is a front isometric view of the food dispensing apparatus of the present invention.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, equivalent structures and methods, and alternative constructions falling within the spirit and scope of the invention as expressed in the appended claims.

The food dispensing apparatus of the present invention has a number of beneficial features. The apparatus has a minimum number of parts for cost savings in production and to enhance handling when assembling and disassembling sections of the apparatus. The apparatus is also easy to assemble and disassemble to facilitate washing; the food path must typically be washed on a daily basis. Thus, the hoses from the food container to the pump and from the pump to the nozzle are easily removed and are water safe. To allow this, the apparatus includes a self-closing valve so that food in the container does not inadvertently spill out. Also, the electrical path to the nozzle is easily engaged and disengaged and is also fully immersible in water without malfunction. Further, the food holding container may be removed easily from the apparatus and put within a refrigeration unit every night. The pump itself is also easily disassembled for washing. Again, the number of parts are minimized so as to reduce the likelihood of parts being misplaced or lost. The apparatus also includes a mechanism to easily count motor revolutions down to a quarter rotation so that food may be accurately dispensed and the amount dispensed may be reproduced time after time. In addition, controls are provided which specifically address pizza sauce dispensing so that different size pizzas may be easily handled, and variations in sauce amounts for each size may be easily accommodated.

Referring now to FIG. 1, there is illustrated a food dispensing apparatus 10 having a base 12 in the form of a stainless steel metal enclosure, a container 14 of food product to be dispensed, a pump 16, a first or supply conduit 18 communicating the product in the container 14 with the pump 16, and a second or dispensing conduit 20 communicating the pump 16 and a nozzle 22. The nozzle 22 is movable between a storage or at rest position where it is supported by a bracket 24 at the front of the base and a dispensing position when an operator holds the nozzle by a handle 26 over a location, usually in front of the base, where food product 28 is situated. A first switch 30 on the nozzle handle 26 may be used to activate the pump. Another switch 32 mounted on the base offers an alternative means for activating the pump.

Referring now to FIGS. 1, 2, 3 and 4, the base 12 includes a front slanted wall 34, a back wall 36, left and right side walls 38, 40, a bottom wall 42 and a flat top wall 44. A motor 46 is mounted within the base to the right side wall 40. Mounting is facilitated with a wall block 48. A motor shaft 50 is connected to a pump shaft 52, which when assembled extends beyond the right side wall 40 to engage the pump 16, for causing the pump to operate when the motor is activated.

Figure 4:
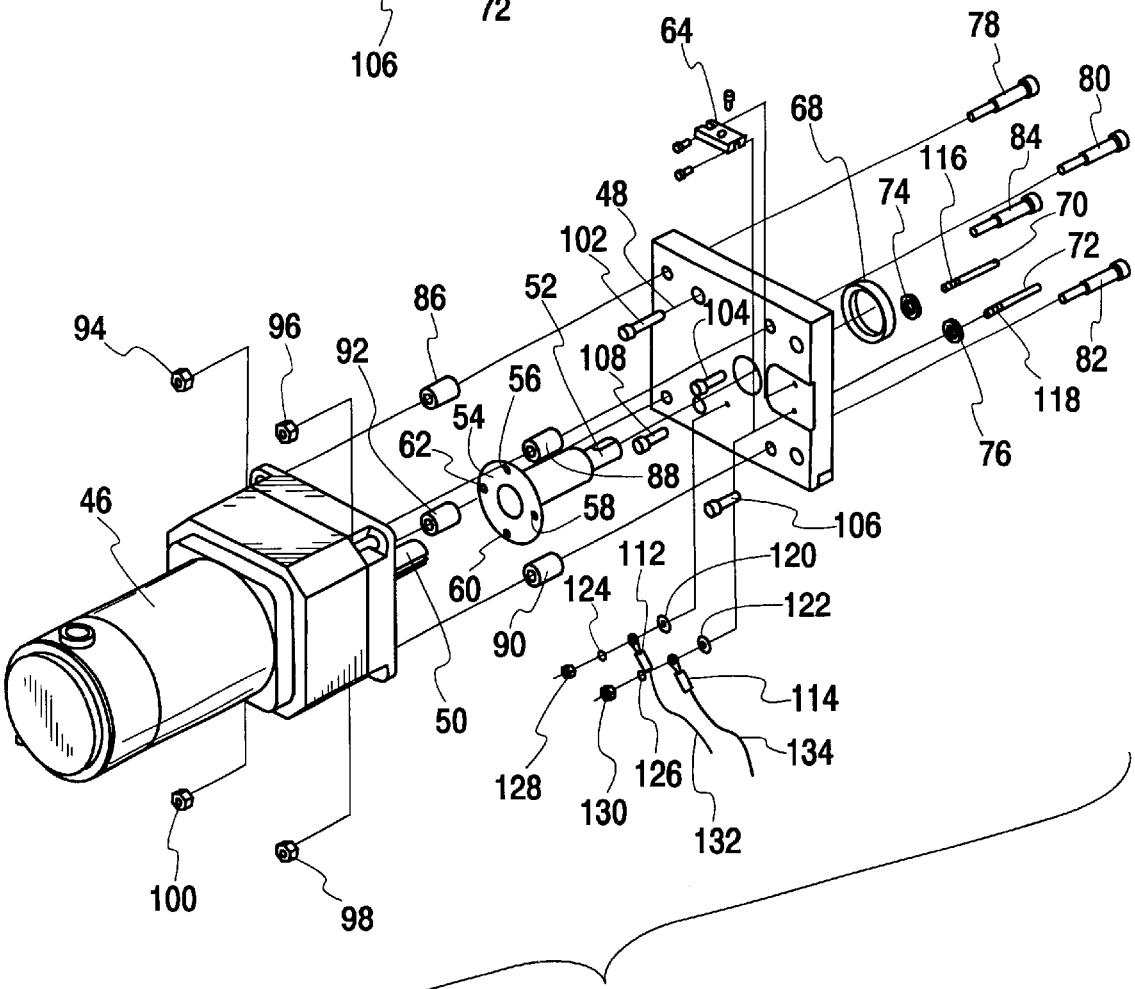
FIG. 4 is an exploded rear isometric view of the motor and mounting plate shown in FIG. 3.

Counting motor revolutions to ensure the feature of consistent and reproducible dispensing amounts is accomplished by a disk 54, FIG. 4, having four openings 56, 58, 60 and 62. The disk is fixed to the pump shaft 52 and attached to the motor shaft 50 by any suitable means, such as threaded fasteners (not shown). An electrical component 64 comprising a light source and a photo sensor is mounted to the wall block 48 to operate with the disk, and is connected to control circuitry 66, FIG. 2, mounted to the back wall 36 of the base. As the disk rotates with the motor shaft and pump shaft, light from the light source of the electrical component 64 will energize the photo sensor every time light passes through one of the openings 56, 58, 60 and 62 of the disk 54. In this way, each revolution of the motor causes four light pulses to be received by the photo sensor. Each pulse creates a signal that is transmitted to a counter in a programmable control circuitry 66. Thus, counting revolutions to a quarter turn is easily accomplished in a simple, economical and reliable manner. Once the programmed number of revolutions have been signaled, the control circuitry switches the motor off.

A seal 68 is provided around the pump shaft 52 where it passes through the right side wall of the base. Two electrical pins 70, 72 made of stainless steel are also mounted to the wall block 48 and these also extend through the right wall 40 of the base 12. Seals 74 and 76 are mounted to the wall block 48 around the pins 70, 72 respectively, to prevent moisture from getting inside the base. Four threaded fasteners 78, 80, 82, 84, four spacers 86, 88, 90, 92 and four nuts 94, 96, 98, 100 are provided to secure the motor and the wall block. An additional four threaded fasteners 102, 104, 106, 108 pass through the wall block 48 and the side wall 40 of the base to mount the motor and block assembly to the base. A power cord 110, FIG. 1, is connected to the motor and allows energy from a wall socket (not shown) to activate the motor. The cord is connected to the control circuitry and the motor in the usual fashion.

The motor 46 is preferably a direct current type and has a one-eighth horse power rating. Such motors may be purchased from Flolo Electric of Calumet City, Ill. Electrical terminals 112, 114 are attached to threaded ends 116, 118 of the electrical pins 70, 72, respectively. Washers 120, 122, lock washers 124, 126 and nuts 128, 130 which engage the electrical pins are provided to make electrical contacts between the pins and electrical wires 132, 134. The wires 132, 134 lead back to the control circuitry 66.

A switch 136, FIG. 1, is connected to the control circuitry for controlling the speed of rotation of the motor 46. The switch may be in the form of a variable resistor. This allows an operator, for example, who is new to the dispensing apparatus to run the motor in a slow mode until he/she reaches a comfort level that allows the speed of the motor to be increased.

Referring now to FIGS. 5–8, the pump 16 is illustrated in more detail. The pump includes an inner housing 138, an outer housing 140 and an impeller 142. The outer housing 140 includes an opening 144 for receiving the impeller. The impeller is mounted to the pump shaft 52, FIG. 4, and the pump shaft extends through an opening 146 in the inner housing 138. A shaft seal 148 is provided to prevent leakage through the opening 146. A casing seal 150 is provided to fit into a recess 151 about the opening 144 and prevents leakage between the inner and outer housings. An impeller pin 152 is connected to the impeller and the impeller slips over the pump shaft 52 so that the pin is received by a slot 153 in the shaft. In this manner the rotational force of the shaft is transferred to the pin which then drives the impeller.

The inner housing 138 has two vertically disposed cylindrical openings 154, 156 relating to the electrical path to be described below. The outer housing also has two vertically disposed cylindrical openings, an input opening 158 and an output opening 160. Both of these openings 158, 160 communicate with the impeller opening 144. The input opening is in communication with the food product in the container 14 and the output opening is in communication with the nozzle 22. The inner housing has four corner openings 162, 164, 166, 168 and the outer housing has four aligned corner openings 170, 172, 174, 176. The two sets of four corner openings allow the pump to be mounted to the base in a simple and effective manner.

Figure 2:
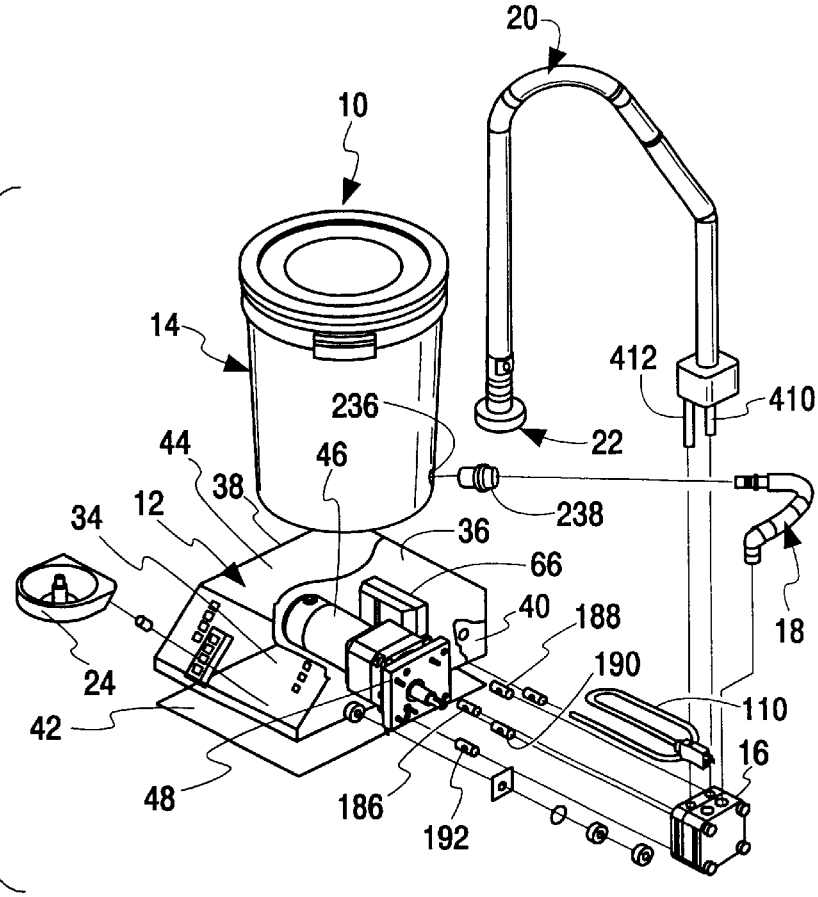
FIG. 2 is an exploded front isometric view, partially broken away, of the food dispensing apparatus shown in FIG. 1.
Figure 3:
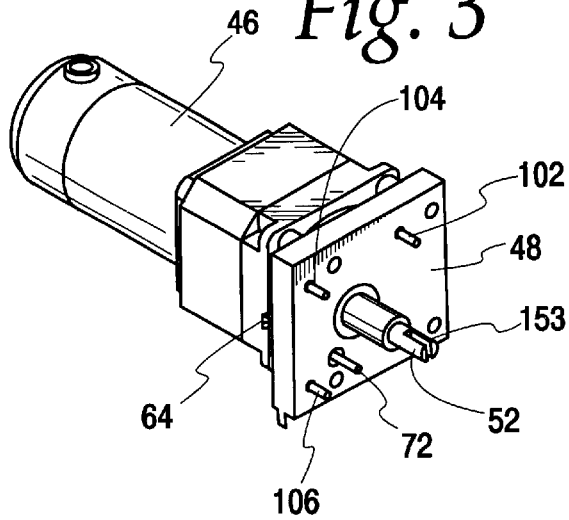
FIG. 3 is a front isometric view of the motor and mounting plate of the food dispensing apparatus shown in FIGS. 1 and 2.
Figure 9:
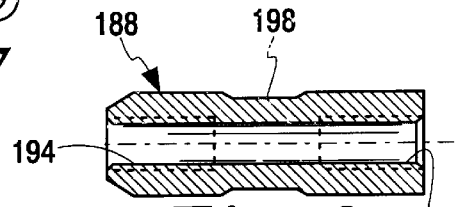
FIG. 9 is a sectional view of a connector used in the food dispensing apparatus shown in FIG. 2.

When discussing the motor and block in relation to FIGS. 3 and 4 above, the four threaded fasteners 102, 104, 106, 108 projected through the wall block 48 and the right wall 40 of the base. Fitted to each of these fasteners is a two headed connector such as the connectors 186, 188, 190, 192, FIG. 2. These connectors, exemplified by the connector 186, FIG. 9, are generally cylindrical in shape and each includes a first threaded end portion 194, an opposite second threaded end portion 196 and a wrench receiving a flattened middle portion 198. The first end portion 194 is threaded to the fastener 102. Each of the other connectors mates with one of the remaining fasteners 104, 106, 108 in the same way. The connectors not only fasten the motor 46 and the wall block 48 to the base but they provide mounting studs over which the pump is mounted. For example, the two aligned sets of openings of the inner and outer housings 162, 164, 166, 168 and 170, 172, 174, 176, respectively, fit over the connectors 186, 188, 190, 192 which are tightly threaded to the threaded fasteners 102, 104, 106, 108, respectively.

Figure 5:
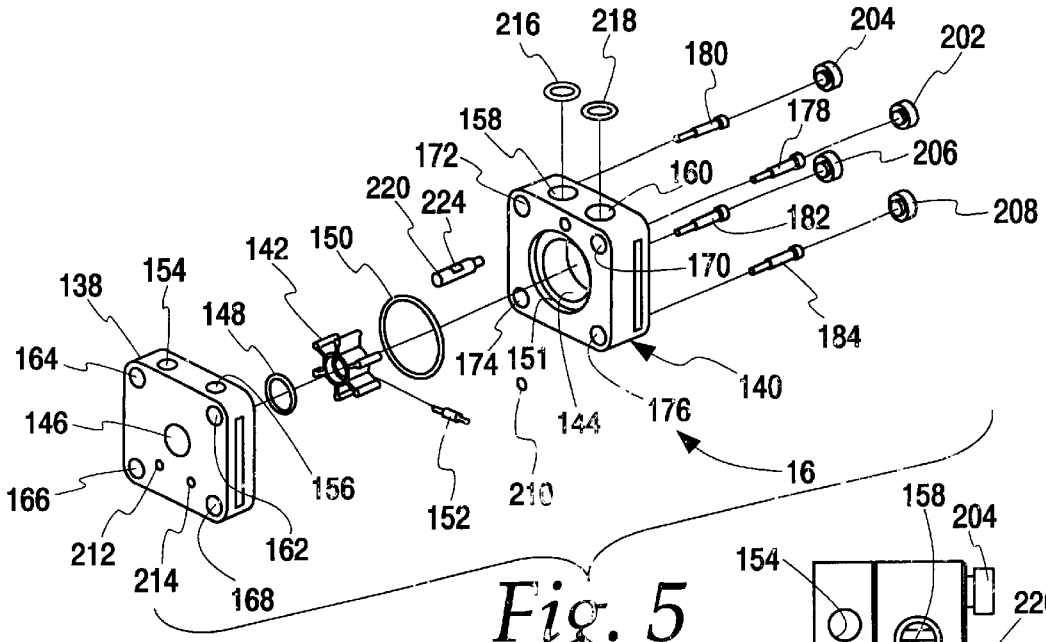
FIG. 5 is an exploded rear isometric view of the pump of the food dispensing apparatus shown in FIGS. 1 and 2.
Figure 8:
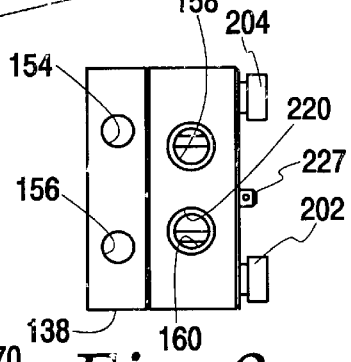
FIG. 8 is an enlarged top plan view of the pump shown in FIG. 5.
Figure 6:
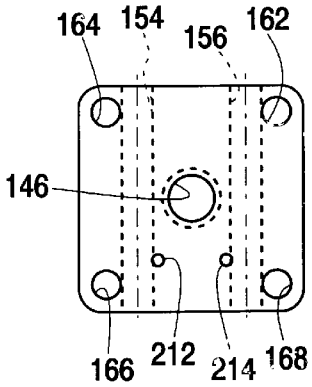
FIG. 6 is an enlarged rear elevation view of the inner housing of the pump shown in FIG. 5.
Figure 7:
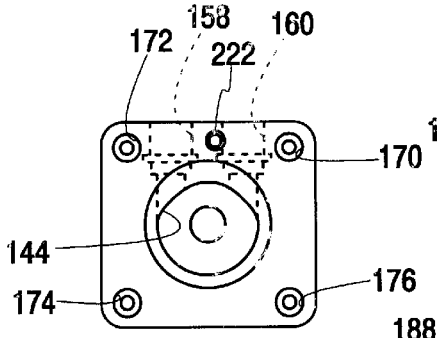
FIG. 7 is an enlarged rear elevation view of the outer housing of the pump shown in FIG. 5.

Four additional threaded fasteners 178, 180, 182, 184, FIG. 5, are provided, each with a knurled knob, such as the knobs 202, 204, 206, 208, to threadedly engage to second end portions of each of the connectors, such as second end portion 196. The fastener and knob combinations are provided to allow quick and easy manual disassembly of the inner and outer pump housings and the impeller to allow all of the parts of the pump to be washed; as can be appreciated, the pump is part of a food path from the container 14 to the nozzle 22 and must be washed regularly. Retainer rings, such as the ring 210, are attached to each of the additional threaded fasteners 178, 180, 184, 186 so that when the housings are disengaged from one another and from the base, the additional fasteners remain with the outer housing 140 and do not become lost or misplaced.

Figure 20:
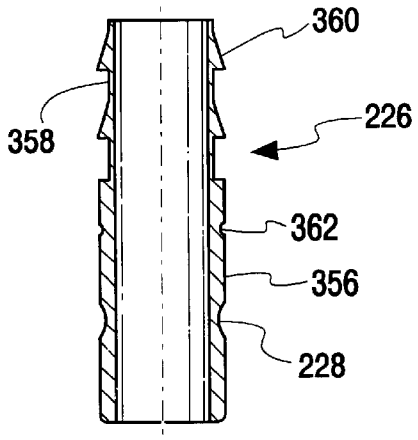
FIG. 20 is an enlarged sectional view of an inner hose adapter shown in FIG. 16.

Two additional openings 212, 214, horizontally disposed, are provided in the inner housing 138 to receive the electrical pins 70, 72, respectively. These pins intersect the vertical cylindrical openings 154, 156 so that rods plugged into the openings 154, 156 will engage the pins 70, 72 as will be explained below. The preferable material for the inner and outer housings is Delrin, a trademark of DuPont for one of its synthetic resins commonly used in food handling equipment. Delrin may also be used for the wall block 48. Sealing rings 216, 218 are provided in the vertical openings 158, 160 of the outer housing 140 to prevent seepage of food product during use of the dispensing apparatus. A locking pin 220 is also provided. The pin slips into a hole 222 in the outer housing 140. The pin has a flat region 224 facing the vertical opening 160 and an adapter 226, as shown in FIG. 20, to be described later, may be inserted into this opening 160. An annular recess 228 in the outer surface of the adapter 226 aligns with the pin. The flat region does not interfere with the adapter 226 when inserted into the opening 160. But when the pin is rotated, the flat region 224 moves away and is replaced with the usual rounded circumference of the pin. This expanded geometry engages the recess 228 and provides a lock of the adapter 226 in the opening 160. Since the pump creates a high pressure in the opening 160, the "output" of the pump, the lock ensures that the adapter 226 is not blown out of the opening 160. The pin has a head portion 227 which extends beyond the outer housing 140 for gripping by an operator.

The pump 16 and the container 14 are bridged by the supply conduit 18. The supply conduit includes a valve adapter 230, FIG. 10, a hose 232 and a pump adapter 234. The container 14 has an opening 236, FIG. 2, near its bottom which is used to receive a valve assembly 238. The valve assembly 238 comprises a housing 240, FIGS. 11–13, having a central opening 242. Three grooves 244, 246, 248 are provided for receiving O-ring seals 250, 252, 254, respectively. The valve assembly 238 includes a threaded downstream outer surface 256 and a flange 258. An outer seal 260 is provided to abut against the flange. An upstream portion of the housing has a smooth outer surface 262. The valve assembly is mounted to the container 14 by having the valve assembly placed within the container. The housing is inserted into the container opening 236 such that the threaded downstream outer surface 256 extends outside the container. The valve assembly is retained by a nut 264 threaded onto the threaded downstream outer surface 256 and tightened against the container wall 14 so as to squeeze the container wall between the nut 264 on the outside and the seal 260 and flange 258 on the inside.

Figure 12:
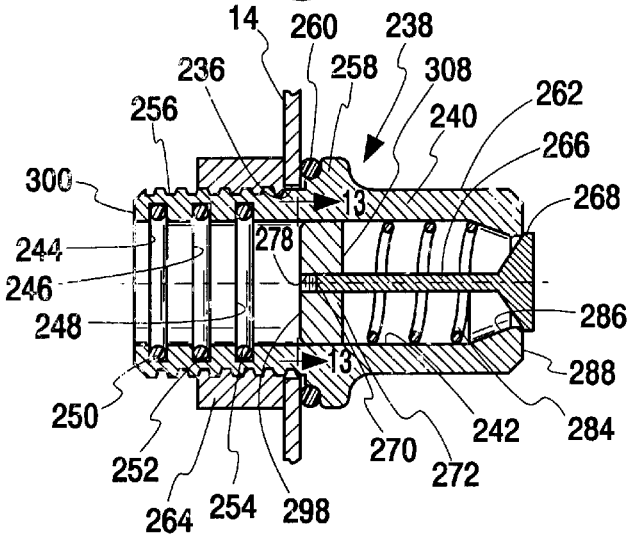
FIG. 12 is an enlarged sectional view of the valve shown in FIG. 11.
Figure 13:
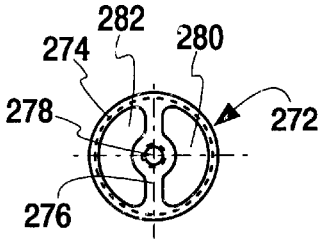
FIG. 13 is an elevation view of a spring retainer taken along line 13—13 of FIG. 12.

Within the central opening 242 is a movable valve element 266 having a head portion 268 at one end and a threaded portion 270 at the other end. A spring retainer 272 is provided to engage the threaded end portion 270 of the movable valve element. The retainer has an outer ring 274 and a bridge 276 with a threaded hole 278. Right and left openings 280, 282 are provided through which food product being dispensed may pass. A spring 284 is trapped between the spring retainer 272 and a converging section 286 of the central opening 242. Normally the spring biases the movable valve element to seat against an outer or upstream surface 288 of the valve assembly 238 as shown in FIG. 12.

Figure 10:
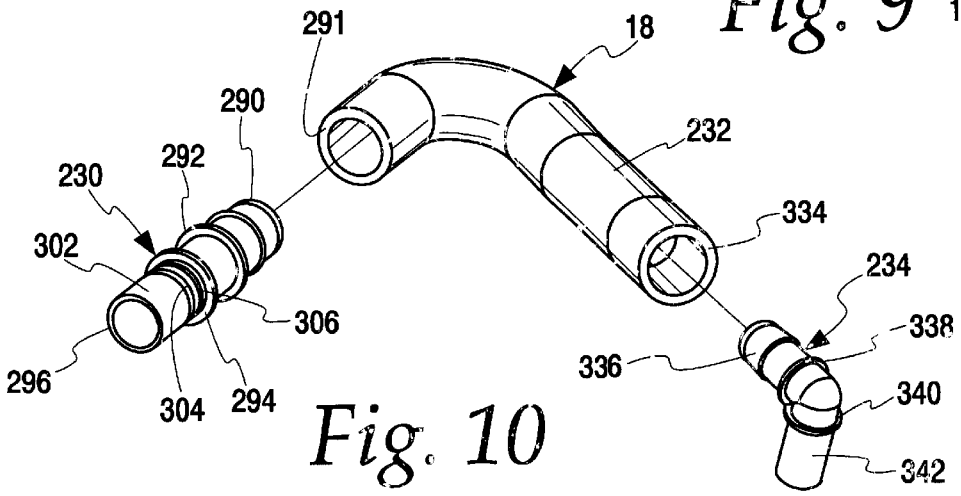
FIG. 10 is an exploded front isometric view of a sauce hose and two adapters used to connect a food container and a pump of the food dispensing apparatus shown in FIGS. 1 and 2.
Figure 11:
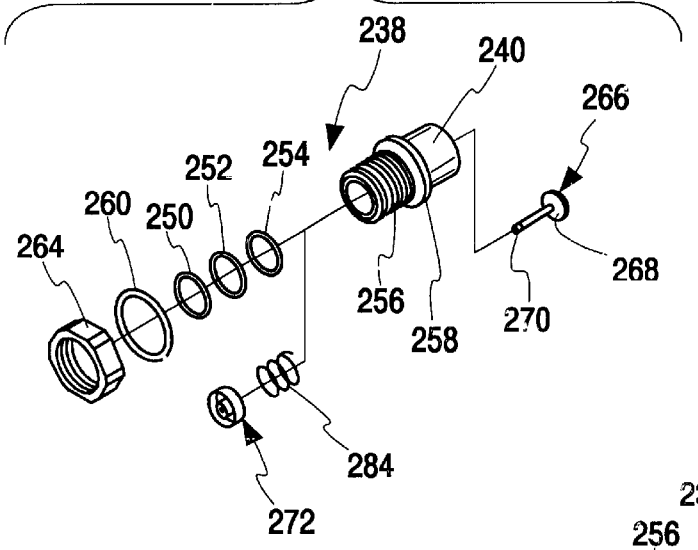
FIG. 11 is a rear exploded isometric view of a valve of the food dispensing apparatus shown in FIGS. 1 and 2.

The valve adapter 230, FIG. 10, is generally tubular in shape and has a first downstream end 290 which fits into an upstream end 291 of the hose 232 until the hose abuts a downstream flange 292. A second upstream flange 294 limits the insertion of the valve adapter into the valve assembly 238, FIG. 11. A leading edge 296 of the valve adapter opens the valve assembly by having the leading edge 296 abut and push a downstream side 298, FIG. 12, of the spring retainer 272. This leading edge engages the spring retainer and causes it to move approximately one-tenth of an inch against the bias of the spring 284. Engagement is complete when the upstream flange 294, FIG. 10, on the valve adapter abuts the downstream edge 300, FIG. 12, of the housing 240. An upstream end 302 of the adapter includes two grooves 304, 306 which engage the O-ring seals 250, 252 of the valve assembly. This is sufficient to retain the valve adapter 230 and the valve assembly 238 in engagement during operation of the dispensing apparatus. The third O-ring 254 acts as a seal and frictionally engages the valve adapter. When the valve adapter 230 is withdrawn from the valve assembly, the biasing spring 284 acting upon the upstream side 308 of the spring retainer 272 causes a leftward movement (with reference to FIG. 12) of the valve element 266 and causes the head portion 268 to engage the upstream surface 288 of the housing 240 thereby closing the valve assembly. Hydrostatic pressure within the container also helps to close the movable valve element as soon as the force acting upon the retainer is removed.

Figure 15:
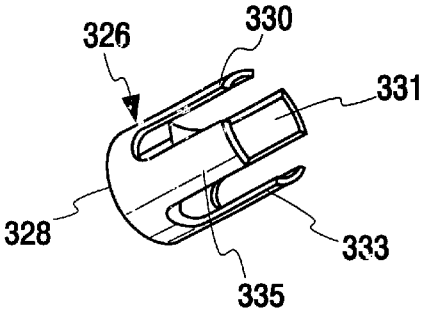
FIG. 15 is an isometric view of a combination spring and retainer of the valve illustrated in FIG. 14.
Figure 14:
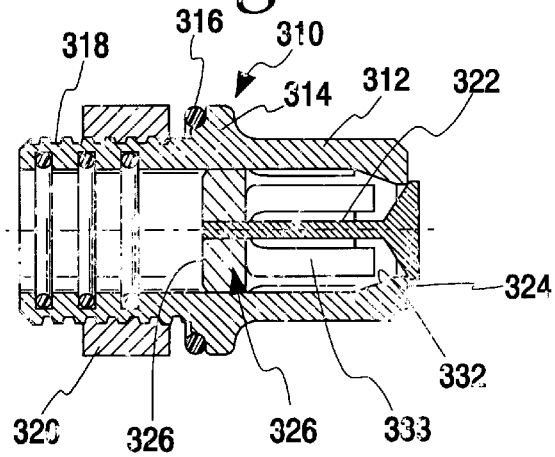
FIG. 14 is a sectional elevation view of a variation of the valve shown in FIG. 11.

Referring now to FIGS. 14 and 15, a variation of the valve assembly is illustrated. Like the FIG. 12 embodiment, the modified valve assembly 310 includes a housing 312, a peripheral flange 314, an O-ring seal 316 and a threaded downstream outer surface 318. A nut 320 is engageable with the downstream outer surface. A valve element 322 is movable away from and into engagement with an upstream surface 324 of the housing. Instead of a spring and spring retainer, there is a one-piece biasing element 326 having a downstream abutment base 328 and extending flexible biasing beams 330, 331, 333, 335. When the valve adapter 230 engages the abutment base 328 of the biasing element, it moves rightwardly opening the valve. At the same time the beams flex inwardly upon sliding along the converging section 332 of the housing. Since the biasing beams have memories, once the valve adapter is removed, the beams will tend to flex outwardly to return to the positions shown in FIGS. 14 and 15. The expansion of the beams against the converging section 332 will cause the valve element to move leftward thereby closing the valve.

A downstream end 334, FIG. 10, of the hose 232 engages the pump adapter 234. The adapter has an upstream end portion 336 which fits inside the hose and an upstream flange 338 for limiting movement of the adapter into the hose. A downstream flange 340 acts as a stop or limit to the insertion of a downstream end portion 342 into the pump 16 through the opening 158 in the outer housing.

Figure 21:
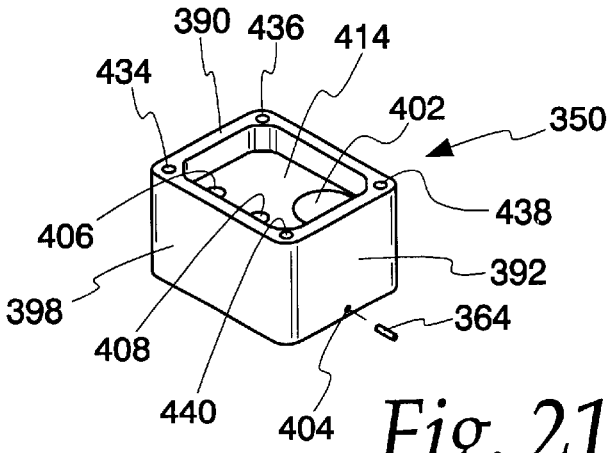
FIG. 21 is an enlarged isometric view of the connector block shown in FIG. 16.
Figure 22:
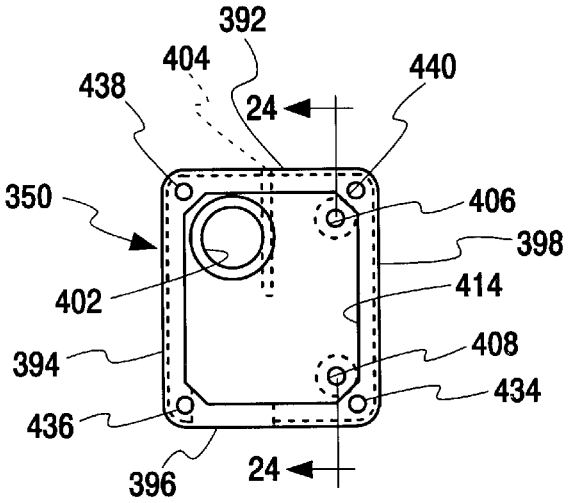
FIG. 22 is a top plan view of the connector block shown in FIG. 21.
Figure 23:
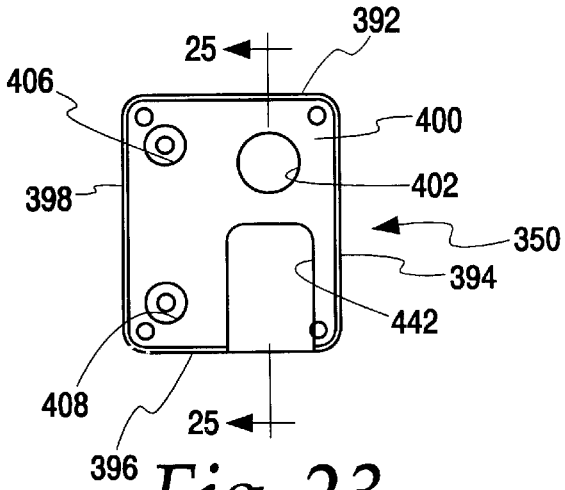
FIG. 23 is a bottom plan view of the connector block shown in FIG. 21.

The conduit 20 between the nozzle 22 and the pump 16 takes the form of a flexible outer hose 344, FIGS. 16–20, a flexible inner hose 346, a metal support tube 348, a support block 350, the upstream adapter 226 and a downstream adapter 354. The food carrying path extends from the output opening 160, FIG. 5, of the pump 16 to the upstream adapter 226 to the inner hose 346 to the nozzle 22. The upstream adapter has a tubular body with an upstream portion 356 and a downstream portion 358. The upstream portion 356 includes an upstream annular recess 228 which is engaged by the locking pin 220, FIG. 5, of the pump 16. When the upstream adapter is plugged into the output opening of the pump and the looking pin is rotated so that the flat portion 224 is moved away from the upstream adapter, the adapter is effectively locked in place. A second smaller annular recess 362 is provided to receive a press fitted pin 364, FIG. 21, into the support block 350. In this fashion the upstream adapter 226 is attached to the support block 350 so that they move during assembly and disassembly as a single unit along with all of the other elements shown in FIG. 16. The downstream portion 358 of the upstream adapter includes annular barbs 360 which are used to frictionally engage the upstream end 361 of the inner hose 346.

A downstream end 365 of the inner hose 346 attaches to a barbed stem 366, FIG. 27, molded with or affixed to the nozzle 22. Between the two ends the inner hose is protected and supported by the support tube 348 and the outer hose 344. The support tube is comprised of a bent stainless steel tube and a stainless steel cover plate 368 which is fastened to the support block 350 by threaded fasteners 370, 372, 374, 376. The support tube 348 in turn is attached to the downstream adapter 354. The downstream adapter 354 includes a tubular upstream portion 378 and a downstream barbed portion 380. A flange 382 separates the two portions and acts to limit both the depth of insertion of the barbed portion 380 into an upstream end 382 of the outer hose 344 and the depth of the upstream end 378 into the support tube 348. The outer hose, made of PVC, extends to its downstream end 384 which receives a barbed upstream end 386, FIGS. 16 and 27, of the handle 26 of the nozzle. The inner hose is made of silicon especially adapted to carry food product.

Figure 16:
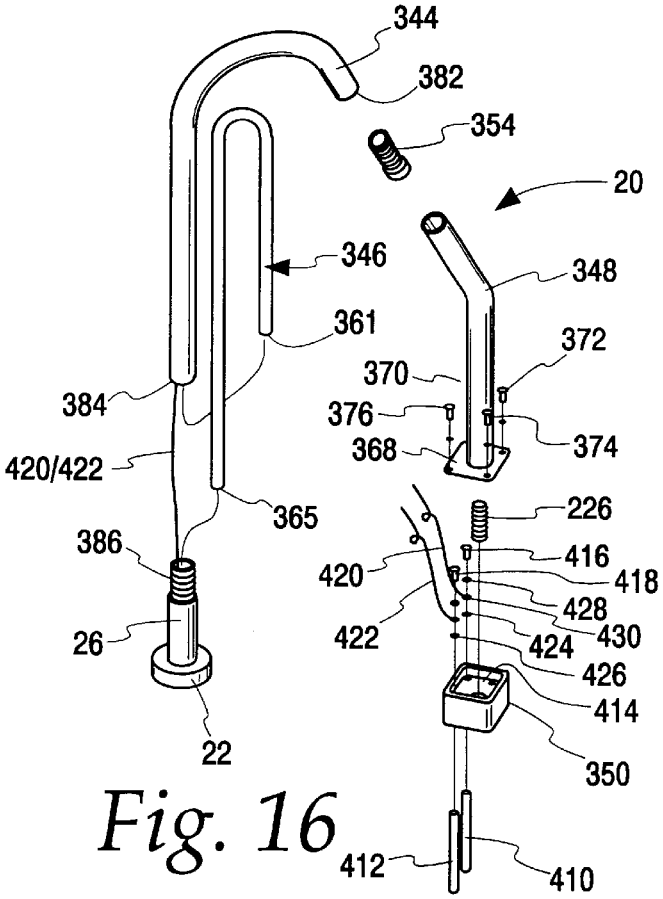
FIG. 16 is a front exploded isometric view of a nozzle, a nozzle handle, an outer hose, an inner hose and a connector block of the food dispensing apparatus shown in FIGS. 1 and 2.
Figure 17:
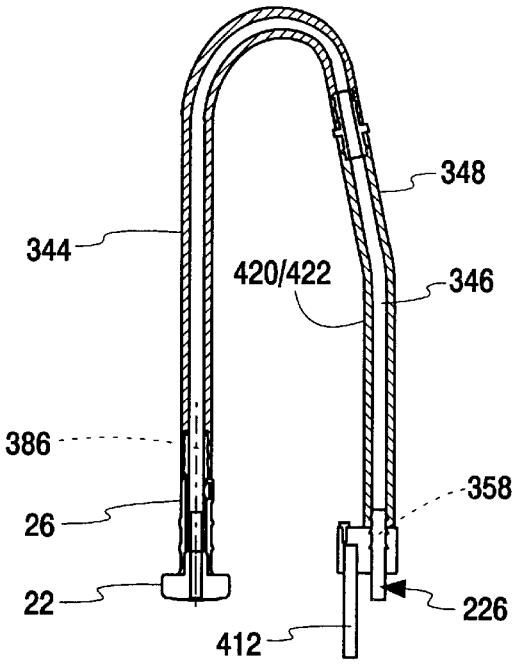
FIG. 17 is a front sectional view of the nozzle assembly shown in FIG. 16.
Figure 18:
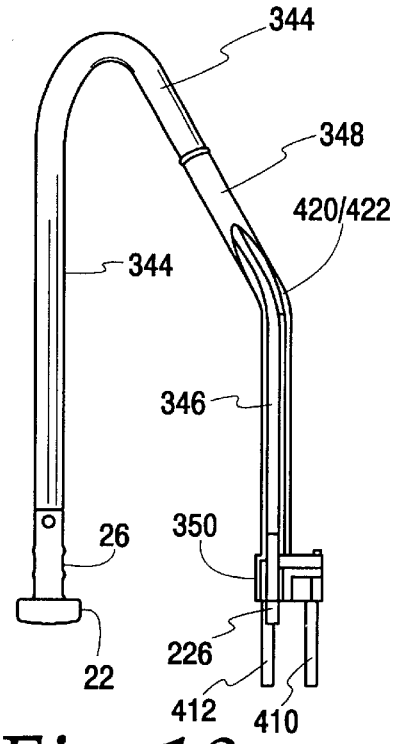
FIG. 18 is a side elevation view, partially broken away, of the nozzle assembly shown in FIGS. 16 and 17.
Figure 19:
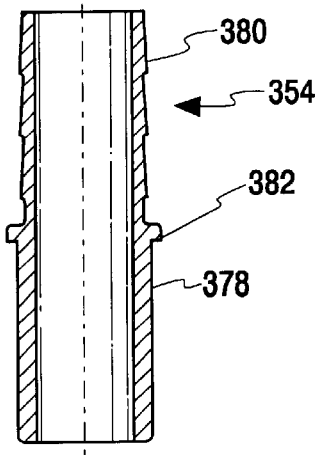
FIG. 19 is an enlarged sectional view of an outer hose adapter shown in FIG. 16.

The support block 350, FIGS. 21–25, is made of Delrin resin and includes an upper surface 390, four side walls 392, 394, 396, 398 and a lower surface 400. Formed in the block is a hole 402 into which is seated the upstream adapter 226, FIG. 16, and the upstream end 361 of the hose 346. A lateral hole 404 is formed in the block to receive the pin 364 that locks the upstream adapter in place. Two parallel holes 406, 408 are also formed in the block. These receive stainless steel rods 410, 412, FIGS. 16 and 18, which terminate in the support block 350 and support not only the block but also the dispensing conduit 20 including the support tube 348, the outer hose 344, the inner hose 346, the upstream adapter 226, the downstream adaptor 354, the handle 26 and the nozzle 22, in other words, all of the elements shown in FIGS. 16–18 are supported. The rods are retained by two threaded fasteners 416, 418. The threaded fasteners also connect two electrical wires 420, 422, respectively, and appropriate washers 424, 426, 428, 430 are also provided. The electrical wires form an electrical path with the rods 410, 412 from the pins 70, 72 to the switch 30. These are all placed in a chamber 414 which is sealed by the plate 368. The electrical wires extend the electrical path from the rods through the support tube 348, the downstream adapter 354, the outer hose 344 and the nozzle handle 26 before terminating at a switch 30 in the handle. The electrical wires parallel the inner hose 346 but are exterior to the inner hose so that food product and the wires never come into contact. Instead, the food path is separate and distinct and so is the electrical path. Furthermore, the electrical wires are sealed so that the conduit 20 can be washed to sanitize the food path and yet no harm comes to the electrical path.

Four openings 434, 436, 438, 440 are provided to receive the fasteners 370, 372, 374, 376 for sealing the plate 368 to the top of the block. In addition, an indentation 442 is provided in the bottom of the support block to accommodate the pump adapter 234, FIG. 10.

The downstream end 384 of the outer hose 344, attaches to the barbed end 386 of the handle 26, FIGS. 26 and 27. The nozzle 22 is press fitted to the opposite end of the handle. Integral with the handle is a projection 444 with an opening 446 for receiving the switch 30. The switch is connected to the wires 420, 422 so that a user may activate the dispenser from the handle. The nozzle has a bowl shaped face 450 surrounding a central opening 452 through which the dispensing product flows. The nozzle face may be relatively flat as is the face 454 shown in FIG. 28 or it may be domed as shown in FIGS. 26 and 27. The shape may depend upon the use for which the dispenser is operated. When the dispenser is being used for very thin crust pizza, it has been found that the domed face 450 operates better, since it does not create an attachment through surface tension or otherwise with the surface of the thin crust pizza. It has been found that the flat face may cause the thin pizza dough to adhere to the sauce and the sauce to the nozzle and tear apart when the nozzle is lifted after the pizza sauce is dispensed.

Reference is now made to FIGS. 29 and 30 where the bracket 24 is illustrated. The bracket has a rounded front surface 460 and a slanted back surface 462. A dishlike recessed surface 464 is formed in the top 466 of the bracket and this surface mates with the nozzle. An upstanding post 468 is formed in the middle of the recess. The size of the recess is such that the nozzle 22 may be received and supported. When the nozzle is placed in the recess 464, the upstanding post 468 is received by the central opening 452, FIG. 26 of the nozzle and the post acts as a plug to prevent or control any leakage from the nozzle. A shoulder 469 is formed in the post for this purpose. As can be seen, the bracket is centrally located on the front slanted wall 34, FIG. 2 of the base, which wall has the same slant as the back surface 462 of the bracket so that mating may occur. This is done for the convenience of the operator and provides the ergonomically beneficial feature of placing the nozzle handle in a convenient location to be gripped by the operator. The nozzle handle 26 is positioned close to the operator and near to the pizza dough on which pizza sauce is to be dispensed.

To facilitate removal of the bracket for cleaning, there are two projections, such as the post 470, mounted to the front wall 34 of the base. Two post openings 472, 474 are formed in the slanted back face of the bracket which allows the bracket to be mounted on the posts simply by aligning the openings with the posts and pressing downwardly toward the front wall of the base. The opposite motion removes the bracket from the slanted wall. The operator merely grips the bracket and moves the bracket at an angle of about 45 degrees from a reference horizontal, such as a counter on which the dispensing apparatus is placed. The bracket may be formed of Delrin while the posts are stainless steel. Again, it can be appreciated how easy it is to disassemble and clean parts of the apparatus and then reassemble them quickly and easily.

The nozzle 22 may also be mounted to an arm 476, FIG. 31, which is movable in a linear and/or a rotatable fashion. The arm may also be mounted to move vertically by any suitable arrangement shown diagrammatically at 477. A rotating platform 478 may also be used. The pizza dough may be placed on the platform to be rotated while the arm may simply be moved back and forth. In this fashion the dispensing process may be automated and the movable arm or the arm in combination with the platform may cause the nozzle to move over the pizza dough in a predetermined pattern. After completion of the sauce dispensing, the nozzle may be lifted and returned to the bracket 24.

As mentioned earlier, there is a unique electrical path used in the present invention to allow the nozzle 22 and the conduit 20 to be easily removed and washed. And, this is true even though the nozzle hose 344 and support block 350 contain electrical elements which are generally incompatible with immersion in water. As explained above, power emanates from a wall socket through the electrical cord 110 to the control circuitry 66 and from there to the motor 46, the switch 32 on the front wall of the base 12 and the switch 30 in the nozzle handle 26. To connect the switch in the nozzle handle there must be an electrical path. This path from inside the base 12 terminates in the pins 70, 72 which then project from the right side wall 40 of the base. The inner and outer housings 138, 140 of the pump are removably connected to the base and two horizontal openings 212, 214 in the inner housing 138 of the pump receive the pins such that they are physically exposed in the vertically disposed cylindrical openings 154, 156 also in the inner housing 138. The two rods 410, 412 connected to the support block, when inserted into the vertical openings, make physical contact with the pins. Since both the pins and the rods are formed of stainless steel, which are good electrical conductors, the electrical path extends from the pins to the rods. Hence, the rods both support the dispensing conduit and also become part of the electrical path. The wires 420, 422 are attached to the upper ends of the rods and extend from the upper portion of the support block through the nozzle hose to the nozzle handle. The switch is mounted in the nozzle handle and is connected to the wires. The wires are sealed against water, as are all other electrically related components except the stainless steel pins and rods.

The front wall 34 of the base 12, FIG. 1, includes a control panel comprising a series of switches. For example, there are four control panel switches 480, 482, 484, 486 on the left side of the front wall and four control switches 488, 490, 492, 32 on the right side of the front wall. The switches on the left determine the basic quantity of pizza sauce to be dispensed. For example, there may be an "S" switch 480 to dispense sauce for a "small" pizza, an "M" switch 482 for a medium size pizza, an "L" switch 484 for a large pizza and an "X" switch 486 for an extra large pizza. In all cases the precise amount of pizza sauce for each of the sizes is predetermined and programmed into the control circuitry so that when the motor is activated, it will rotate the predetermined number of revolutions and then stop. For example, it may be predetermined that 163¼ revolutions of the motor will cause the pump to dispense two cups of sauce which may be the right amount of sauce for a large pizza as determined by the operator of the apparatus.

The switches on the right may control such features as extra sauce, switch 488 (and labeled "+"), less sauce, switch 490 (and labeled "−"), a cycle start, switch 32 (and labeled "C") and initial set up, switch 492 (and labeled "*"). During set up, motor revolutions for each pizza size are programmed into the control circuitry. The number of extra revolutions or a percentage for more sauce and the number of revolutions or percentage to be subtracted for less sauce may also be programmed into the control circuitry. The number of revolutions added or subtracted are from the number of revolutions programmed for each size pizza and determined by the S, M, L and X switches.

For thin crust pizza, it has been found that a suitable pizza is created when the motor dispenses a half cup of sauce for a small pizza, a full cup for a medium pizza, a cup and a half for a large pizza and two cups for an extra large pizza. An extra large pizza has a diameter of eighteen inches, a large size pizza has a diameter of sixteen inches, a medium size pizza has a diameter of twelve inches and a small pizza has a diameter of ten inches. Depressing the "extra" switch causes the motor to revolve an additional twenty-five percent more revolutions than the programmed number based on size. Depressing the "less" switch will subtract twenty-five percent of the number of revolutions from the predetermined amount based on size. Pressing the cycle start switch causes the control circuitry to reset in anticipation of new instructions from the operator.

The control circuitry may include a programmable microprocessor of the type commonly available. A suitable microprocessor is GE Programmable Logic Controllers and may be purchased from Powermation, located in Illinois and Minnesota. As explained, the microprocessor is programmed with the number of motor revolutions for each of four sized pizzas. Thus, when a signal is received from one of the four switches 480, 482, 484 and 486, the motor, upon activation of the "cycle" switch 32 or the switch 30 on the nozzle handle will proceed to rotate the number of predetermined revolutions. If the "extra" or "less" switch 488, 490 is also depressed, then more or less revolutions will occur. Each switch is illuminated and is sold by Newark Electronics for MGR Industries, Inc.

In operation, the dispensing apparatus is first calibrated. This is done by an operator who meters sauce into a measuring cup, the amount of sauce he/she normally uses for each pizza size. In some cases an experienced operator may "eyeball" the amount to be used. In others the operator has already determined the exact amounts. After the pump is primed, the operator momentarily depresses a pizza size switch on the left, "S", "M", "L" or "X", and the "set up" switch 492 on the right. Then he/she depresses the "cycle" switch 32 (or the nozzle switch 30) while a cup or other container is filled to the desired level. These operations program the apparatus. The same technique is used to calibrate the "extra" or "less" operations. There is a light associated with each switch so that the operator is informed which switches have been depressed.

Once calibration is completed, an operator places a disk of pizza dough in front of the base, lifts the nozzle from the bracket by the nozzle handle and brings the nozzle to a position just above the disk of pizza dough. The operator begins dispensing sauce by pressing the appropriate size switch and the cycle switch either on the nozzle handle or on the front wall of the base. The amount dispensed is determined by revolutions of the impeller which in turn is directly tied to the number of revolutions of the motor shaft. The number of revolutions of the motor shaft is predetermined by the user. Once the motor has rotated the predetermined number of revolutions, the motor will stop automatically. During the time that the motor is rotating, the operator will move the nozzle about the pizza dough to spread the sauce evenly over the dough. When the operator is finished, he/she replaces the nozzle into the bracket and the pizza dough with the sauce is moved to another station, or other ingredients are brought to the same station and deposited on the pizza. Thereafter, the pizza is baked in an oven until finished.

The specification describes in detail several embodiments of the present invention. Other modifications and variations will under the doctrine of equivalents come within the scope of the appended claims. Various types of containers of food to be dispensed may be used. A large plastic bucket is illustrated in FIGS. 1 and 2, however, food to be dispensed may be packaged in soft sided resin packages. The specific shape of the base may be varied as a function of the counter space available or of the packaging of the food to be dispensed as may be the shape of the nozzle. The nozzle handle may also be modified to the taste of various operators. The apparatus may also be used to deposit sauce on food items beside pizza. Still other alternatives will also be equivalent as will many new technologies. There is no desire or intension here to limit in any way the application of the doctrine of equivalents.

What is claimed is:

1. A dispensing apparatus comprising in combination:

a base;

a motor operatively connected to said base;

a pump operatively connected to said base and being operable by said motor;

a first conduit adapted to connect said pump and a container of product to be pumped;

a nozzle operatively connected to said pump, said nozzle being moveable between a storage position and a dispensing position;

a second conduit for connecting said pump and said nozzle;

an electrical conducting wire adapted to connect said motor to a source of power;

a first switch connected to said electrical line adapted to control power from the source of power to said motor; and a bracket removably mounted to said base, said bracket for mounting said nozzle when said nozzle is in said storage position and for controlling leakage of product from said nozzle.

2. An apparatus as claimed in claim 1 wherein:

said bracket has a dish shape with an upstanding post within said dish shape.

3. An apparatus as claimed in claim 2 wherein:

said bracket includes a surface for mating with said nozzle.

4. An apparatus as claimed in claim 2 wherein:

said bracket includes a surface for mating with said base.

5. An apparatus as claimed in claim 4 wherein:

said bracket and said base have engageable openings and projections.

6. An apparatus as claimed in claim 5 wherein:

said bracket and said base have complementary slanted surfaces.

7. An apparatus as claimed in claim 6 wherein:

said projections are mounted to said base and said openings are formed in said bracket.

8. An apparatus as claimed in claim 7 wherein:

said bracket includes a surface for mating with said nozzle.

9. An apparatus as claimed in claim 8 wherein:

said post includes a shoulder for engaging said nozzle.

10. An apparatus as claimed in claim 1 including:

a monitoring element operatively connected to said motor for indicating the number of revolutions made by said pump.

11. An apparatus as claimed in claim 1 including:

a container for storing product to be pumped; and a valve having a valve seat, an element movable between open and closed positions, and a biasing element, said valve being removably connected to said container, and said movable element being biased to said closed position;

said first conduit having an end portion for biasing said valve element to said open position.

12. An apparatus as claimed in claim 1 including:

said first switch being connected to said nozzle and movable therewith; and an electrical path connected to said second conduit and operatively connecting said first switch and said motor, said electrical path including two metal mounting pins and an electrical wire.

13. An apparatus as claimed in claim 12 including:

a container for storing product to be pumped;

a valve having a valve seat, an element movable between open and closed positions, and a biasing element, said valve being removably connected to said container, and said movable element being biased to said closed position; and an end portion on said first conduit for biasing said valve element to said open position.

14. An apparatus as claimed in claim 13 including:

a monitoring element operatively connected to said motor for indicating the number of revolutions made by said pump, said monitoring element including a rotatable disk having spaced openings therein, and a circuit having a light source, a light detector and a counting component for counting the number of times light passes through said spaced openings.

15. A dispensing apparatus comprising in combination:

a base;

a motor operatively connected to said base;

a pump operatively connected to said base and being operable by said motor;

a first conduit adapted to connect said pump and a container of product to be pumped;

a nozzle operatively connected to said pump, said nozzle being movable between a storage position and a dispensing position;

a second conduit for connecting said pump and said nozzle;

an electrical conducting wire adapted to connect said motor to a source of power;

a first switch connected to said electrical line adapted to control power from the source of power to said motor; and a monitoring element operatively connected to said motor for indicating the number of revolutions made by said pump.

16. An apparatus as claimed in claim 15 wherein:

said monitoring element including a rotatable disk having spaced openings therein, and a circuit having a light source, a light detector and a counting component for counting the number of times light passes through said spaced openings.

17. An apparatus as claimed in claim 16 including:

a shaft mounted to said motor; and wherein:

said disk is mounted to said shaft.

18. An apparatus as claimed in claim 16 including:

a mounting block connected to said base; and wherein:

said light source and said light detector are mounted to said mounting block; and said pump is mounted to said mounting block.

19. An apparatus as claimed in claim 15 including:

a first panel switch for signaling that a small amount of product is to be dispensed;

a second panel switch for signaling that a medium amount of product is to be dispensed;

a third panel switch for signaling that a large amount of product is to be dispensed; and a fourth panel switch for signaling that an extra large amount of product is to be dispensed.

20. An apparatus as claimed in claim 15 including:

a fifth panel switch for signaling that an extra amount of product is to be dispensed, said extra amount being a function of the amount determined by the first, second, third or fourth panel switch; and a sixth panel switch for signaling that a lesser amount of product is to be dispensed, said lesser amount being a function of the amount determined by the first, second, third or fourth panel switch.

21. An apparatus as claimed in claim 15 including:

a container for storing product to be pumped; and a valve having a valve seat, an element movable between open and closed positions, and a biasing element, said valve being removably connected to said container, and said movable element being biased to said closed position; and wherein:

said first conduit has an end portion for biasing said valve element to said open position.

22. An apparatus as claimed in claim 15 wherein:

said first switch is connected to said nozzle and movable therewith; and including:

an electrical path connected to said second conduit and operatively connecting said first switch and said motor, said electrical path including two metal mounting pins and an electrical wire.

23. An apparatus as claimed in claim 22 including:

a bracket removably mounted to said base, said bracket for mounting said nozzle when said nozzle is in said storage position and for controlling leakage from said nozzle.

24. An apparatus as claimed in claim 23 including:

a shaft mounted to said motor; and a mounting block connected to said base; and wherein:

said monitoring element including a rotatable disk having spaced openings therein, and a circuit having a light source, a light detector and a counting component for counting the number of times light passes through said spaced openings;

said pump is mounted to said mounting block;

said circuit is programmable;

said disk is mounted to said shaft; and said light source and said light detector are mounted to said mounting block.

25. A dispensing apparatus comprising in combination:

a base;

a motor operatively connected to said base;

a pump operatively connected to said base and being operable by said motor;

a first conduit adapted to connect said pump and a container of product to be pumped;

a nozzle operatively connected to said pump, said nozzle being movable between a storage position and a dispensing position;

a second conduit for connecting said pump and said nozzle;

an electrical conducting wire adapted to connect said motor to a source of power;

a first switch connected to said electrical wire adapted to control power from the source of power to said motor;

a container for storing product to be pumped;

a valve having a valve seat, an element movable between open and closed positions, and a biasing element, said valve being removably connected to said container, and said movable element being biased to said closed position; and an end portion on said first conduit for biasing said valve element to said open position.

26. An apparatus as claimed in claim 25 wherein said valve includes:

a retainer connected to said movable element; and a housing having an internal chamber; and wherein said biasing element is trapped between said retainer and a portion of said housing within said internal chamber.

27. An apparatus as claimed in claim 26 wherein:

said end portion of said first conduit engages said retainer.

28. An apparatus as claimed in claim 26 wherein:

said retainer has a round periphery and at least one passageway; and said biasing element is a coil spring.

29. An apparatus as claimed in claim 26 wherein:

said retainer and said biasing element are integral; and said internal chamber includes a converging wall.

30. An apparatus as claimed in claim 29 wherein:

said biasing element comprises a plurality of flex beams.

31. An apparatus as claimed in claim 26 including:

a plurality of O-rings mounted within said housing in said internal chamber.

32. An apparatus as claimed in claim 25 including:

an electrical path connected to said second conduit and operatively connecting said first switch and said motor, said electrical path including two metal mounting pins and an electrical wire; and wherein said first switch is connected to said nozzle and movable therewith.

33. An apparatus as claimed in claim 25 including:

a shaft mounted to said motor;

a disk with peripheral openings mounted to said shaft; and a circuit having a light source, a light detector and a counting means for counting the number of times light passes through said openings, said circuit being mounted to said base.

34. A dispensing apparatus comprising in combination:

a base;

a motor operatively connected to said base;

a pump operatively connected to said base and being operable by said motor;

a first conduit adapted to connect said pump and a container of product to be pumped;

a nozzle operatively connected to said pump, said nozzle being moveable between a storage position and a dispensing position;

a second conduit for connecting said pump and said nozzle;

an electrical conducting wire adapted to connect said motor to a source of power;

a first switch connected to said electrical wire adapted to control power from the source of power to said motor;

said first switch being connected to said nozzle and movable therewith; and an electrical path connected to said second conduit and operatively connecting said switch and said motor, said electrical path including two metal rods and electrical wire.

35. An apparatus as claimed in claim 34 including:

an internal food carrying tube mounted in said second conduit; and wherein:

said electrical wire is located adjacent said internal tube.

36. An apparatus as claimed in claim 35 including:

a support block; and wherein said rods are mounted to said support block;

said internal food carrying tube is mounted to said support block; and said electrical wire is connected to said rods in said support block.

37. An apparatus as claimed in claim 36 including:

a cover for said support block;

a rigid outer support tube connected to said cover; and said support tube for containing said internal food tube and said electrical wire.

38. An apparatus as claimed in claim 34 including:

a bracket removably mounted to said base, said bracket for mounting said nozzle when said nozzle is in said storage position and for controlling leakage of product from said nozzle;

a container for storing product to be pumped;

a valve having a valve seat, an element movable between open and closed positions, and a biasing element, said valve being removably connected to said container, and said movable element being biased to said closed position;

an end portion of said first conduit for biasing said valve element to said open position;

a monitoring element operatively connected to said motor for indicating the number of revolutions made by said pump, said monitoring element including a rotatable disk having spaced openings therein, and a circuit having a light source, a light detector and a counting component for counting the number of times light passes through said spaced openings; and a second switch for stopping said motor after a predetermined number of revolutions or fractions thereof.

* * * * *